US006351109B1

(12) United States Patent
Yoshida

(10) Patent No.: US 6,351,109 B1
(45) Date of Patent: Feb. 26, 2002

(54) INTEGRATED CIRCUIT

(75) Inventor: Megumi Yoshida, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/501,709

(22) Filed: Feb. 10, 2000

(30) Foreign Application Priority Data

Feb. 26, 1999 (JP) ..... 11-049897

(51) Int. Cl.[7] ..... G05F 1/40
(52) U.S. Cl. ..... 323/284; 323/274
(58) Field of Search ..... 323/311, 312, 323/313, 274, 282, 283, 284, 285

(56) References Cited

U.S. PATENT DOCUMENTS 5,926,009 A * 7/1999 Kim ..... 323/284
6,160,392 A * 12/2000 Shin ..... 323/313
6,236,194 B1 * 5/2001 Manabe et al. ..... 323/284

FOREIGN PATENT DOCUMENTS

JP 61118019 A 6/1986
JP 04039956 2/1992
JP 04103637 3/1992
JP 04152891 5/1992
JP 05258085 10/1993
JP 05283997 10/1993
JP 05326825 12/1993

* cited by examiner

*Primary Examiner*—Jessica Han
(74) *Attorney, Agent, or Firm*—Morrison & Foerster LLP

(57) ABSTRACT

In case that the power source voltage rises fast, the reset signal is set in the low level when the power source is supplied, so that the PMOS transistor T1 is switched ON and the node N1 is shifted to the high level. Because the node N1 is connected to the earth line VSS through the NMOS transistor T2, the NMOS transistor T2 is switched ON when the power source voltage reaches the predetermined value. Thus, by giving a small resistance value to the resistor R1, the node N1 can shift from the high level to the low level without delay, whereby the nodes N2 and N3 are set to the high level, thereby setting the reset signal to the high level. In addition, while the reset signal stays in the high level, the PMOS transistor T1 is switched OFF to cut the current. Consequently, it has become possible to provide an integrated circuit which can save the standby current consumption and at the same time output the reset signal properly in response to the power source voltage at any rising rate.

12 Claims, 8 Drawing Sheets

CASE OF SLOW RISING

CASE OF FAST RISING

CASE OF SLOW RISING

CASE OF FAST RISING

CASE OF SLOW RISING

CASE OF FAST RISING

INTEGRATED CIRCUIT

FIELD OF THE INVENTION

The present invention relates to an integrated circuit, and more particularly, to an integrated circuit which outputs a reset signal when detecting transition of a power source voltage.

BACKGROUND OF THE INVENTION

A conventional integrated circuit 31 is shown in FIG. 7, which serves as a power source detecting circuit for outputting a reset signal upon detection of a rising and a falling of a power source voltage.

As shown in the drawing, resistors R4 and R5 are connected in series between a power source line VDD and an earth line VSS, and a connection point (node N12) of these two resistors is connected to the gate of an NMOS transistor T16. The source of the NMOS transistor T16 is connected to the earth line VSS, and the drain thereof is connected to the power source line VDD through a resistor R6. Also, a connection point (node N13) of the NMOS transistor T16 and resistor R6 is connected to the gates of a PMOS transistor T17 and an NMOS transistor T18.

The source of the PMOS transistor T17 is connected to the power source line VDD, and the drain thereof is connected to the drain of the NMOS transistor T18, while the source of the NMOS transistor T18 is connected to the earth line VSS. A connection point (node N3) of the PMOS transistor T17 and NMOS transistor T18 is a reset terminal from which a reset signal is outputted.

In order to save a standby current consumption of the power source detecting circuit, the resistors employed therein are generally given with large resistance values; For example, in case of the integrated circuit 31, the resistance values of the resistors R4 and R5 are both approximately 54000 kΩ and the resistance value of the resistor R6 is approximately 75000 kΩ.

The following will explain the operation of the integrated circuit 31 given with relatively large resistance values in cases of fast rising and slow rising power source voltages with reference to timing charts shown in FIGS. 8 and 9, respectively. In these drawings, a voltage is used as the ordinate and a time is used as the abscissa, and a broken line represents a power source voltage.

A case of the slow rising power source voltage with the rise time of longer than 1 ms will be explained first. As shown in FIG. 8, at start-up of the power source voltage, a voltage at the node N12, which shows a value of the power source voltage divided by the resistors R4 and R5, increases as the power source voltage rises. Because the NMOS transistor T16 stays OFF until the voltage at the node N12 reaches the threshold of the NMOS transistor T1, a voltage at the node N13 increases as high as the power source voltage through the resistor RG. When the voltage at the node N13 reaches the threshold of the NMOS transistor T18, the PMOS transistor T17 is switched OFF whereas the NMOS transistor T18 is switched ON, whereby a voltage at the node N3, that is, the reset signal, shifts to a low level from an initial floating state immediately after the power source supply.

Eventually, a voltage at the node N12 increases and exceeds the threshold of the NMOS transistor T16. Then, the NMOS transistor T16 is switched ON, whereby the voltage at the node N13 shifts to the low level. Accordingly, the PMOS transistor T17 is switched ON whereas the NMOS transistor T18 is switched OFF, whereby the reset signal shifts to a high level from the low level.

Then, while the power source voltage maintains a normal value, the voltage at the node N3 stays in the high level,. and when the power source voltage starts to drop, the voltage at the node N3 drops as low as the power source voltage, because the PMOS transistor T17 stays ON. When the voltage at the node N12 drops below the threshold of the NMOS transistor T16, the NMOS transistor T16 is switched OFF and the voltage at the node N13 increases as high as the power source voltage, thereby shifting to the high level. Consequently, the NMOS transistor T18 is switched ON whereas the PMOS transistor T17 is switched OFF, whereby the voltage at the node N3 shifts to the low level.

As has been discussed, in case of the slow rising power source voltage, the integrated circuit 31 detects the rising and falling of the power source voltage, and outputs a pulse of a high-level signal as a reset signal from the reset terminal (node N3) while the power source voltage maintains a predetermined value (normal period).

Next, a contrarily case of the fast rising power source voltage with the rise time of shorter than 100 As will be explained with reference to FIG. 9. As shown in the drawing, at start-up of the power source voltage, an increase of the voltage at the node N12 is delayed and gradual in comparison with the rising of the power source voltage. Thus, the voltage at the node N12 stays in the low level longer, during which an increase of the voltage at the node N13 is also delayed and gradual in comparison with the rising of the power source voltage. Throughout this period, the voltage at the node N13 keeps increasing, but remains in the low level. Then, when the voltage at the node N12 exceeds the threshold of the NMOS transistor T16, the NMOS transistor T16 is switched ON, whereupon the voltage at the node N13 starts to drop further. Accordingly, the NMOS transistor T18 stays OFF throughout the rising period of the power source voltage, while the voltage at the node N3 stays in the floating state until the PMOS transistor T17 is switched ON and then starts to increase as high as the power source voltage when the PMOS transistor T17 is switched ON.

As has been discussed, in case of the fast rising power source voltage, the reset signal has a potential as high as that of the power source voltage at start-up and starts in the high level. Thus, the integrated circuit 31 can not recognize the low level, and therefore, is unable to control the rising of the rest signal.

Generally, the power source voltage does not fall fast, and for this reason, the voltages at the nodes N12, N13, and N3 fall in the same manner as was described in case of the slow rising power source voltage. Thus, the integrated circuit 31 can control the falling of the reset signal.

Other examples of the integrated circuit which outputs a reset signal are disclosed in the following publications. Japanese Laid-open Patent Application No. 258085/1993 (Japanese Official Gazette, Tokukaihei No. 5-258085, published on Oct. 8, 1993) discloses an integrated circuit which can readily output a reset signal in case of either fast or slow rising power source voltage. Japanese Laid-open Patent Application No. 283997/1993 (Japanese Official Gazette, Tokukaihei No. 5-283997, published on Oct. 29, 1993) discloses an integrated circuit having a high voltage source and a low voltage source, so that a malfunction of a circuit operating on a high voltage source is prevented when a voltage in the low voltage source drops. Japanese Laidopen Patent Application No. 326825/1993 (Japanese Official Gazette, Tokukaihei No. 5-326825, published on Dec. 10, 1993) discloses an integrated circuit which stops supply of the power source when the power source voltage drops to or below a predetermined value, so that damages caused by external noise is prevented. Japanese Laid-open Patent Application No. 118019/1986 (Japanese Official Gazette, Tokukaisho No. 61-118019, published on Jun. 5, 1986) discloses an integrated circuit which secures clearing job stability by setting a clearing time for an internal circuit after detecting that the power source voltage has reached the operable lower limit voltage of the internal circuit.

As has been discussed, the conventional integrated circuit 31 can not control the rising of the reset signal in case of the fast rising power source voltage. Thus, a circuit which is to be reset by the integrated circuit 31 may not be initialized properly. Smaller values may be given to the resistors R4, R5, and R6, so that the reset operation is performed properly in response to the power source voltage at any rising rate. However, in this case, there is a problem that a standby current consumption (a current flowing from the power source line VDD to the earth line VSS through the resistors R4 and R5, and a current flowing from the power source line VDD to the earth line VSS through the resistor R6 and NMOS transistor T16) of the integrated circuit 31 increases undesirably while the circuit to be reset is on standby, that is, while it is ready to accept commands, such as signal reading, writing, erasing, etc.

In case of the integrated circuit of Japanese Laid-open Patent Application No. 258085/1993 supra, a reset signal can be generated properly also in case of the fast rising power source voltage, but it can not control the standby current consumption. Further, the integrated circuits in the rest of the foregoing publications do not concern a problem arising from the rising rate of the power source voltage.

SUMMARY OF THE INVENTION

It is therefore an object of the present invention to provide an integrated circuit which can save the standby current consumption and output a reset signal properly in response to the power source voltage at any rising rate.

In order to fulfill the above and other objects, an integrated circuit of the present invention for generating a reset signal in a normal period during which a power source voltage maintains a predetermined threshold is furnished with: first and second power source voltage detecting circuits for detecting whether the power source voltage reaches the threshold or not, each having a different operation rate and different power consumption; and a reset signal generating circuit for generating the reset signal based on detection results from the first and second power source voltage detecting circuits, the second power source voltage detecting circuit having a higher operation rate being furnished with a cutting circuit for cutting a current flowing therein when the first power source voltage detecting circuit having smaller power consumption detects that the power source voltage reaches the threshold. The cutting circuit may cut the current either partially or entirely. It should be appreciated, however, that the more the current is cut, the more the power consumption of the integrated circuit is saved.

According to the above arrangement, because the operation rate of the second power source voltage detecting circuit is set high, even when the power source voltage rises fast, the reset signal can be generated without causing any conventional problem that the reset signal has a potential as high as the power source voltage and starts in the high level. Further, after the first power source voltage detecting circuit having a smaller current consumption detects the rising of the power source voltage, the current flowing in the second power source voltage detecting circuit is cut by the cutting circuit, and the reset signal generating circuit generates the reset signal based on the detection result from the first power source voltage detecting circuit. Consequently, the current consumption is saved considerably compared with a case where the second power source voltage detecting circuit keeps operating on one hand, and on the other hand, the falling of the power source voltage which happens gradually in comparison with the rising can be detected in a secure manner. Thus, an integrated circuit which can save the standby current consumption and at the same time output the reset signal properly in response to the power source voltage at any rising rate can be provided.

It is preferable that the integrated circuit is further arranged in such a manner that: each of the first and second power source voltage detecting circuits is furnished with a resistor and a detecting circuit, the resistor being provided on a DC path starting from a first power source line to which the power source voltage is supplied and ending at a second power source line kept at a predetermined potential lower than the power source voltage, the detecting circuit detecting whether the power source voltage reaches the threshold based on a potential at one end of the resistor serving as a first node; a resistance value of the resistor provided to the second power source voltage detecting circuit is set smaller than a resistance value of the resistor provided to the first power source voltage detecting circuit; and the cutting circuit is a switch provided on the DC path in the second power source voltage detecting circuit.

According to the above arrangement, a smaller resistance value is given to the resistor in the second power source voltage detecting circuit compared with that in the first power source voltage detecting circuit. Hence, power consumption of the first power source voltage detecting circuit can be readily set smaller than that of the second power source voltage detecting circuit. In addition, the operation rate of the second power source voltage detecting circuit can be set higher than that of the first power source voltage detecting circuit. Further, after the first power source voltage detecting circuit detects that the power source voltage reaches the threshold, the DC path in the second power source voltage detecting circuit is cut, in which a larger current flows compared with the DC path in the first power source voltage detecting circuit, thereby saving the power consumption of the integrated circuit considerably. Consequently, an integrated circuit which can save the standby current consumption and at the same time output the reset signal properly in response to the power source voltage at any rising rate can be provided.

It is preferable that the integrated circuit is further arranged in such a manner that: the second power source voltage detecting circuit maintains an output at a level at the instant the current is cut while the current is kept cut; and the reset signal generating circuit includes a logical circuit which maintains the reset signal at a first level indicating the normal period when both of the first and second power source voltage detecting circuits detect that the power source voltage reaches the threshold. The above arrangement makes it possible to assemble the reset signal generating circuit with a basic logical circuit.

In each of the above arrangements, once the first power source voltage detecting circuit detects that the power source voltage reaches the threshold, the power consumption can be saved for any cutting period during which the current is kept cut by the cutting circuit. It should be appreciated, however, that the longer the cutting period, the more the power consumption can be saved.

It is preferable that the integrated circuit is further arranged in such a manner that the cutting circuit cuts the current when the reset signal indicates the normal period. According to the above arrangement, the current flowing in the second power source voltage detecting circuit is cut while the reset signal is maintained by the first power source voltage detecting circuit, whereby the power consumption can be saved more compared with a case where the current is cut for a segment in the normal period.

Also, in addition to the arrangement of the resistor, the integrated circuit may be arranged in such a manner that: the detecting circuit of the second power source voltage detecting circuit detects that the power source voltage reaches the threshold when a potential at the first node shifts to a low level from a high level, and wherein the second power source voltage detecting circuit is further furnished with: a first switching element which is provided between a lower potential end of the resistor serving as the first node and the second power source line and conducts when the power source voltage is applied to a control terminal and reaches a predetermined switching ON level; a capacitor provided between the low potential end of the resistor and the first power source line; and a second switching element provided between a high potential end of the resistor and the first power source line.

In the above arrangement, the first switching element keeps conducting until the power source voltage reaches the switching ON level. Under these conditions, even if the second switching element is cut, the potential at the first node is as high as the power source voltage through the capacitor. Thus, the potential at the first node can be set to the high level immediately before the power source voltage reaches the switching ON level.

Further, when the power source voltage reaches the switching ON level, the first switching element shifts to the conducting state. Under these conditions, the power source voltage has reached the switching ON level, and therefore, the second switching element conducts without causing any problem. Consequently, the potential at the first node drops as low as the potential of the second power source line and shifts to the low level. Thus, the detecting circuit can detect that the power source voltage reaches the threshold even in case of the fast rising power source voltage.

Under these conditions, even if the second switching element serving as the switch is cut, the first node stays in the low level because the first switching element is conducting. Consequently, the second power source voltage detecting circuit can maintain the output at the value at the instant the power source voltage reaches the threshold even if the second switching element is cut.

As another preferable embodiment, in addition to the arrangement of the resistor, the integrated circuit may be arranged in such a manner that: the detecting circuit of the second power source voltage detecting circuit is furnished with a detecting unit which detects that the power source voltage reaches the threshold when a potential at a second node shifts to a low level from a high level; a serial resistor connected to the first power source line at one end; a first switching element which is provided between the other end of the serial resistor and the second node and conducts when a potential at the second node reaches a predetermined switching ON level; and a second switching element which is provided between the second node and the second power source line and conducts when a potential at the first node reaches a predetermined switching ON level, and wherein the second power source voltage detecting circuit is further furnished with: a third switching element which is provided between a high potential end of the resistor serving as the first node and the first power source line, connected to the first node at a control terminal, and conducts when the power source voltage reaches a predetermined switching ON level; a fourth switching element which is provided between a low potential end of the resistor and the second power source line as the switch and conducts while the reset signal is generated; a fifth switching element which is provided between the first node and the first power source line and kept cut while the reset signal is generated; and a capacitor provided between the first node and the second power source line.

According to the above arrangement, the potential at the first node is as low as the potential of the second power source line through the capacitor when the power source is supplied. Because the first through fifth switching elements are in the cutting state at this point, the potential at the first node increases by the parasitic capacity of the first switching element as the power source voltage applied to the first power source line rises. As the power source voltage rises further and reaches the switching ON level of the first and third switching elements, the first and third switching elements start to conduct, whereby the potential at the first node and the potential at the second node start to increase. Consequently, the potential at the second node keeps increasing until the second switching element starts to conduct. Thus, the potential at the second node can be set to the high level immediately before the second switching element starts to conduct.

On the other hand, when the potential at the second node reaches the switching ON level of the second switching element and the second switching element starts to conduct, the potential at the second node starts to drop gradually, because it is connected to the second power source line through the second switching element. When the power source voltage exceeds the predetermined value, the potential at the second node drops further and shifts to the low level. Consequently, the detecting unit can generate the reset signal even in case of the fast rising power source voltage.

Under these conditions, even if the fourth switching element serving as the switch is cut, the second node is maintained at the high level and the first node is maintained at the low level, because the fifth switching element is conducting. Thus, even if the fourth switching element is cut, the second power source voltage detecting circuit can maintain the output at the value at the instant the power source voltage reaches the threshold.

For a fuller understanding of the nature and advantages of the invention, reference should be made to the ensuing detailed description taken in conjunction with the accompanying drawings.

DESCRIPTION OF THE EMBODIMENTS (Embodiment 1)

Figure 1:
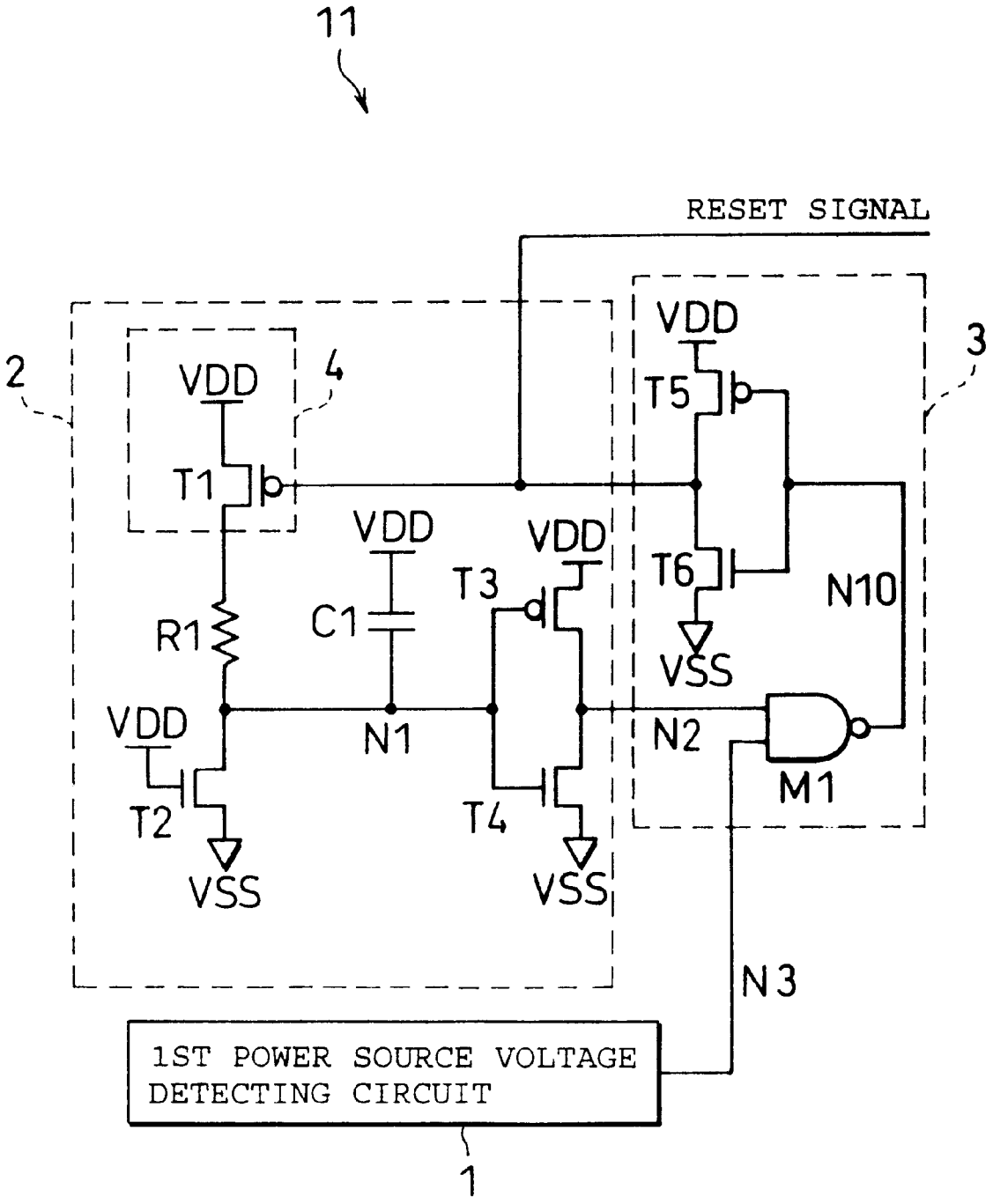
FIG. 1 is a circuit diagram depicting an arrangement of an integrated circuit in accordance with one embodiment of the present invention.
Figure 2:
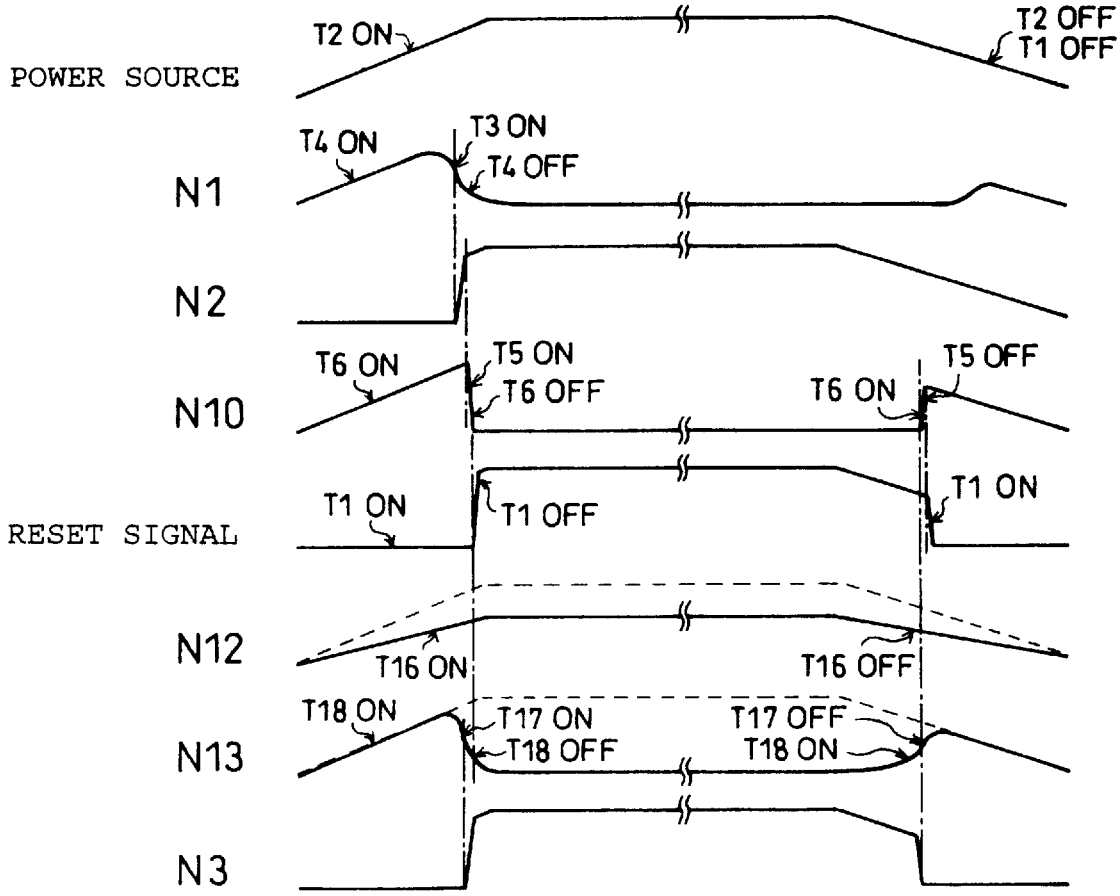
FIG. 2 is a timing chart explaining the operation of the integrated circuit of FIG. 1 in case of a slow rising power source voltage.
Figure 3:
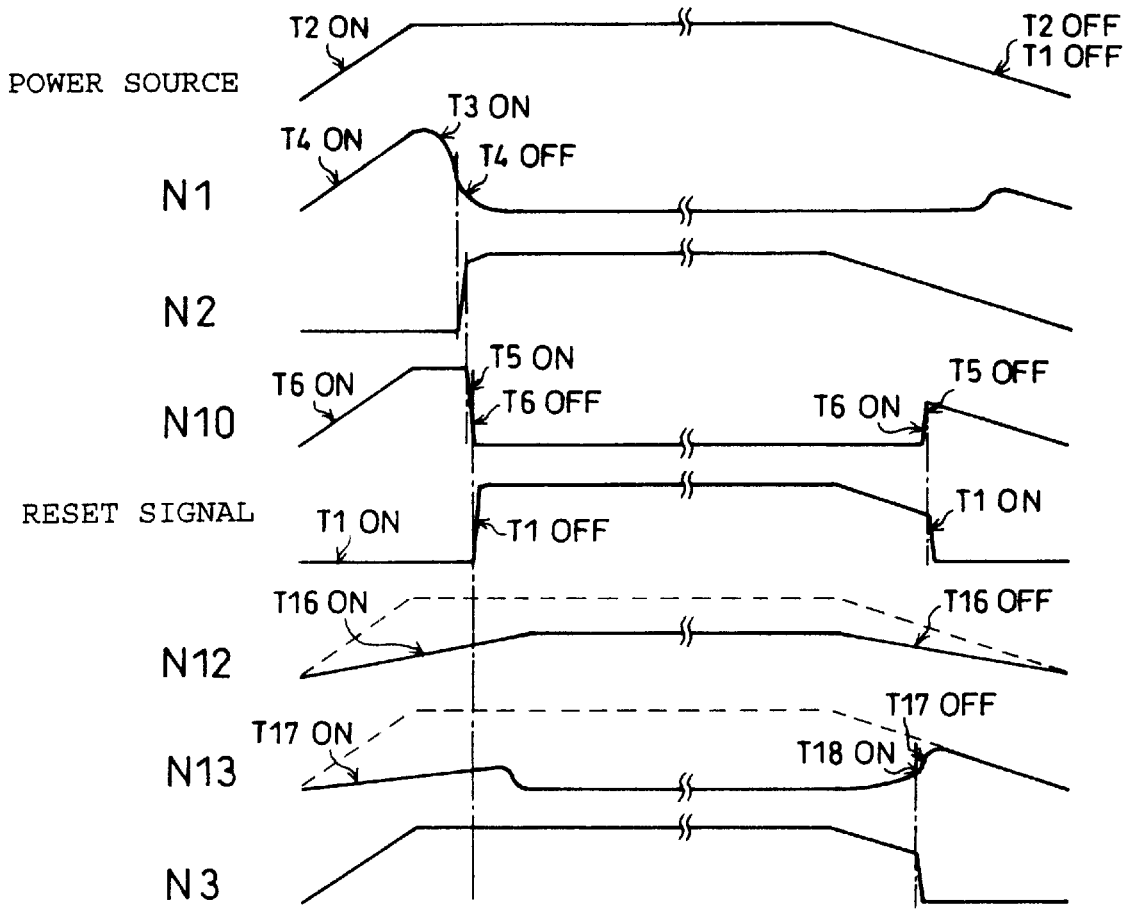
FIG. 3 is a timing chart explaining the operation of the integrated circuit of FIG. 1 in case of a fast rising power source voltage.

Referring to FIGS. 1 through 3, the following description will describe an integrated circuit in accordance with one embodiment of the present invention.

An arrangement of an integrated circuit 11 of the present embodiment is shown in FIG. 1. The integrated circuit 11 includes a first power source voltage detecting circuit 1, a second power source voltage detecting circuit 2, and a reset signal generating circuit 3.

The first power source voltage detecting circuit 1 is of the same structure as that of the integrated circuit 31 of the prior art, and the explanation of the same is omitted for ease of explanation. It should be noted, however, that the resistors R4, R5 and R6 are given with large values to save the standby current consumption of the integrated circuit 11.

The second power source voltage detecting circuit 2 is arranged as follows. That is, a serial circuit composed of a PMOS transistor T1, a resistor R1, and an NMOS transistor T2 is formed between a power source line (an applying line at the high voltage end of the power source voltage;first power source line) VDD and an earth line (an applying line at the low voltage end of the power source voltage;second power source line). The gate of the PMOS transistor (second switching element;switch;cuttiing circuit) T1 is connected to a reset terminal of the reset signal generating circuit 3 which will be described below, the source thereof is connected to the power source line VDD, and the drain thereof is connected to one end of the resistor RI. The gate (control terminal) of the NMOS transistor (first switching element) T2 is connected to the power source line VDD, the drain thereof is connected to the other end of the resistor R1, and the source thereof is connected to the earth line VSS.

A connection point (node N1;first node) of the resistor R1 and NMOS transistor T2 is connected to the power source line VDD through a capacitor C1. A CMOS inverter (detecting circuit) composed of a PMOS transistor T3 and an NMOS transistor T4 is formed between the power source line VDD and earth line VSS. The source of the PMOS transistor T3 is connected to the power source line VDD, and the drain thereof is connected to the drain of the NMOS transistor T4. The source of the NMOS transistor T4 is connected to the earth line VSS. Further, each of the gates of the PMOS transistor T3 and NMOS transistor T4 is connected to the node N1.

Figure 7:
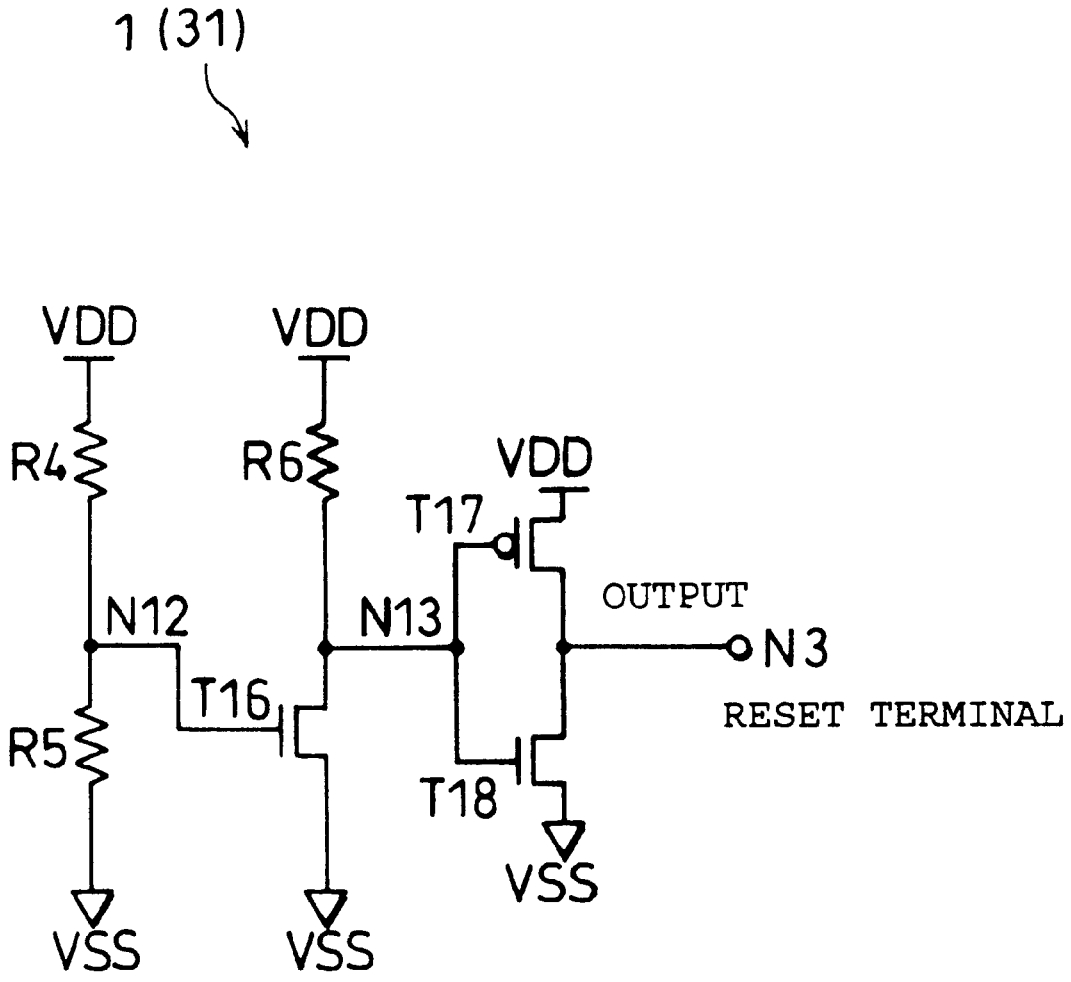
FIG. 7 is a circuit diagram showing an arrangement of a first power source voltage detecting circuit provided in the integrated circuit of the present invention and that of a conventional integrated circuit.
Figure 8:
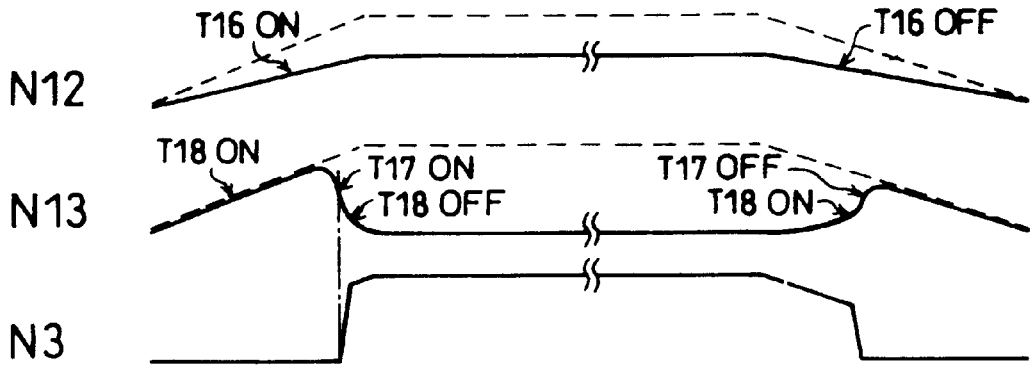
FIG. 8 is a timing chart explaining the operation of the integrated circuit of FIG. 7 in case of a slow rising power source voltage.
Figure 9:
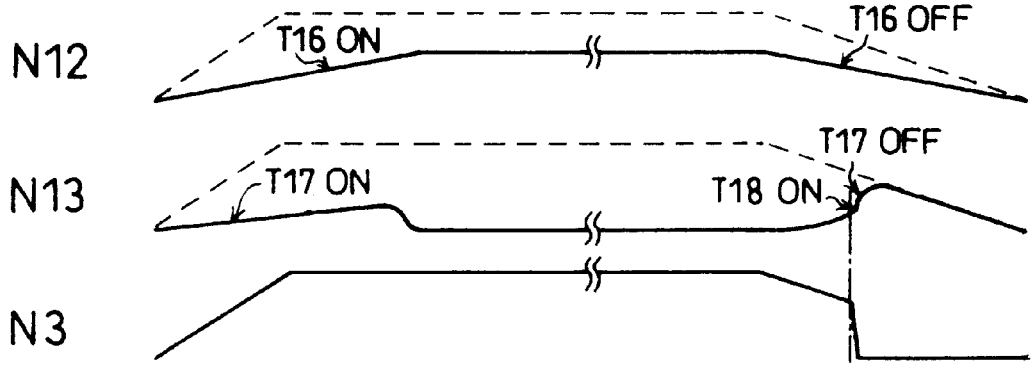
FIG. 9 is a timing chart explaining the operation of the integrated circuit of FIG. 7 in case of a fast rising power source voltage.

Approximately 150 kΩ, which is a significantly small value in comparison with the resistance value (approximately 75000 kΩ) of the resistor R6 of the first power source voltage detecting circuit 1 of FIG. 7, is given to the resistor R1 and a capacity of the capacitor C1 is approximately 3 pF. Because a small resistance value is given to the resistor R1, the second power source voltage detecting circuit 2 consumes a current significantly in comparison with the first power source voltage detecting circuit 1, but it can detect transition of the power source voltage in case of the fast rising power source voltage. Also, the PMOS transistor T1 forms a DC path cutting circuit (current cutting circuit) 4 which cuts a DC path during standby, so that a current does not flow from the power source line VDD to the earth line VSS through the PMOS transistor T1, resistor R1, and NMOS transistor T2.

The reset signal generating circuit (logical circuit) 3 includes a NAND circuit M1 which receives an output signal from the node N3 of the first power source voltage detecting circuit 1 and an output signal from the node N2 of the second power source voltage detecting circuit 2, and a CMOS inverter which outputs an inversion signal of an output signal (voltage at the node N10) from the NAND circuit M1. The CMOS inverter is composed of a serial circuit having a PMOS transistor T5 and an NMOS transistor T6 provided between the power source line VDD and earth line VSS. Each of the gates of the PMOS transistor T5 and NMOS transistor T6 is connected to the node N10, the source of the PMOS transistor T5 is connected to the power source line VDD, and the drain thereof is connected to the drain of the NMOS transistor T6. Also, the source of the NMOS transistor T6 is connected to the earth line VSS.

A connection point of the PMOS transistor T5 and NMOS transistor T6 is connected to an external circuit (not shown) as a reset terminal, and to the gate of the PMOS transistor T1 of the second power source voltage detecting circuit 2.

The following will explain the operation of the above-arranged integrated circuit 11 in cases of the slow rising and fast rising power source voltages with reference to timing charts of FIGS. 2 and 3, respectively.

The case of the slow rising power source voltage will be explained with reference to FIG. 2. When the power source voltage is supplied to the power source line VDD, in the second power source voltage detecting circuit 2, the voltage at the node N1 increases through the capacitor C1 as the power source voltage rises, and reaches the threshold of the NMOS transistor T4, whereupon the PMOS transistor T3 is switched OFF whereas the NMOS transistor T4 is switched ON. Consequently, the voltage at the node N2 shifts to the low level. Thus, an output of the NAND circuit M1 which receives a voltage at the node N2, that is, a voltage at the node N10, shifts to the high level regardless of a voltage at the node N3. Accordingly, in the CMOS inverter in the reset signal generating circuit 3, the PMOS transistor T5 is switched OFF whereas the NMOS transistor TG is switched ON, whereby the reset signal shifts to the low level from the initial floating state immediately after the power source supply.

When the reset signal shifts to the low level, the PMOS transistor T1 is switched ON. Then, the node N1 is connected to the power source line VDD through the resistor R1 and PMOS transistor T1, whereby the voltage thereat shifts to the high level. Also, when the power source voltage reaches the threshold of the NMOS transistor T2, the NMOS transistor T2 is switched ON, and the node N1 is also connected to the earth line VSS through the NMOS transistor T2. Consequently, the voltage at the node N1 shifts to the low level from the high level when the power source voltage reaches a predetermined value (high level).

As has been discussed, by giving a small resistance value to the resistor R1, the node N1 becomes able to detect the rising of the power source voltage because its voltage level changes without delay when the power source voltage exceeds the predetermined value, thereby functioning as the rising detecting terminal. Also, because the PMOS transistor T3 is switched ON whereas the NMOS transistor T4 is switched OFF at this change, the voltage at the node N2 increases as high as the power source voltage and shifts to the high level.

On the other hand, in the first power source voltage detecting circuit 1, the voltages at the nodes N12, N13, and N3 vary with the rising of the power source voltage in the same manner as was described in the prior art column, and the voltage at the node N3 shifts to the high level when the voltage at the node N2 does so, whereby the voltage at the node 10 shifts to the low level. Thus, in the CMOS inverter of the reset signal generating circuit 3, the PMOS transistor T5 is switched ON whereas the NMOS transistor T6 is switched OFF. Thus, the reset signal increases as high as the power source voltage and shifts to the high level. At the same time, the PMOS transistor T1 serving as the DC path cutting circuit 4 is switched OFF. Thus, the DC path from the power source line VDD to the earth line VSS through the PMOS transistor T1, resistor R1, and NMOS transistor T2 is cut. Hence, even if the resistor R1 is given with a small resistance value, the standby current consumption of the second power source voltage detecting circuit 2 can be saved.

Then, the reset signal stays in the high level while the power source voltage maintains a normal value. When the power source voltage starts to drop, the voltage at the node N2 and the reset signal start to drop as well, because the PMOS transistors T3 and T5 stay ON. Then, when the voltage at the node N3 drops to the low level, the voltage at the node N10 shifts to the high level, and in the CMOS inverter of the reset signal generating circuit 3, the PMOS transistor T5 is switched OFF whereas the NMOS transistor TG is switched ON, whereby the reset signal shifts to the low level.

Next, the following will explain the case of the fast rising power source voltage with reference to FIG. 3. As shown in the drawing, in the second power source voltage detecting circuit 2, when the power source voltage is supplied to the power source line VDD the voltage at the node N1 increases through the capacitor C1 as the power source voltage rises. When the voltage at the node N1 reaches the threshold of the NMOS transistor T4, the PMOS transistor T3 is switched OFF whereas the NMOS transistor T4 is switched ON, whereby the voltage at the node N2 shifts to the low level. Thus, the voltage at the node N10 shifts to the high level regardless of the voltage at the node N3. Hence, in the CMOS inverter of the reset signal generating circuit 3, the PMOS transistor T5 is switched OFF whereas the NMOS transistor T6 is switched ON. Consequently, the reset signal shifts to the low level from the initial floating state immediately after the power source supply.

When the reset signal shifts to the low level, the PMOS transistor T1 is switched ON, whereby the node N1 is connected to the power source line VDD through the resistor R1 and PMOS transistor T1, and the voltage thereat shifts to the high level. When the power source voltage reaches the threshold of the NMOS transistor T2, the NMOS transistor T2 is switched ON, whereby the node N1 is also connected to the earth line VSS through the NMOS transistor T2. Consequently, when the power source voltage reaches a predetermined value (high level), the voltage at the node N1 shifts to the low level from the high level without delay, because the resistor R1 is given with a small resistance value. Also, because the PMOS transistor T3 is switched ON whereas the NMOS transistor T4 is switched OFF at such shifting, the voltage at the node N2 increases as high as the power source voltage and shifts to the high level.

On the other hand, in the first power source voltage detecting circuit 1, the voltages at the nodes N12, N13, and N3 vary with the rising of the power source voltage in the same manner as was described in the prior art column, and the voltage at the node N3 has shifted to the high level before the voltage at the node N2 does so. Consequently, the voltage at the node N10 shifts to the low level. Thus, in the CMOS inverter of the reset signal generating circuit 3, the PMOS transistor T5 is switched ON whereas the NMOS transistor T6 is switched OFF, whereby the reset signal increases as high as the power source voltage and shifts to the high level.

As has been discussed, by using the output of the first power source voltage detecting circuit 1 and the output of the second power source voltage detecting circuit 2, the rising of the reset signal can be controlled even in case of the fast rising power source voltage. At the same time, because the PMOS transistor T1 serving as the DC path cutting circuit 4 is switched OFF, the DC path from the power source line VDD to the earth line VSS through the PMOS transistor T1, resistor R1, and NMOS transistor T2 is cut, thereby making it possible to save the standby current consumption of the second power source voltage detecting circuit 2.

Then, the reset signal stays in the high level while the power source voltage maintains a normal value. When the power source voltage starts to drop, the voltage at the node N2 and the reset signal start to drop as well, because the PMOS transistors T3 and T5 stay ON. Then, when the voltage at the node N3 drops to the low level, the voltage at the node N10 shifts to the high level, and in the CMOS inverter of the reset signal generating circuit 3, the PMOS transistor T5 is switched OFF whereas the NMOS transistor T6 is switched ON, whereby the reset signal shifts to the low level.

In the above-arranged second power source voltage detecting circuit 2, because the power source voltage at the falling and the output of the second power source voltage detecting circuit 2 (voltage at the node N2) have the same potential, the voltage at the node N2 stays in the high level, and therefore, the integrated circuit 11 can not recognize the low level in the voltage at the node N2. Thus, in order to control the falling of the reset signal by detecting the falling of the power source voltage, the integrated circuit 11 of the present embodiment uses the falling of the voltage at the node N3 in the first power source voltage detecting circuit 1.

As has been discussed, according to the integrated circuit 11 of the present embodiment, whether in case of the slow or fast rising power source voltage, a reset signal can be generated properly in response to the rising and falling of the power source voltage. Also, because an arrangement such that cuts the DC path at the same time is provided, the standby current consumption can be saved.

(Embodiment 2)

Figure 4:
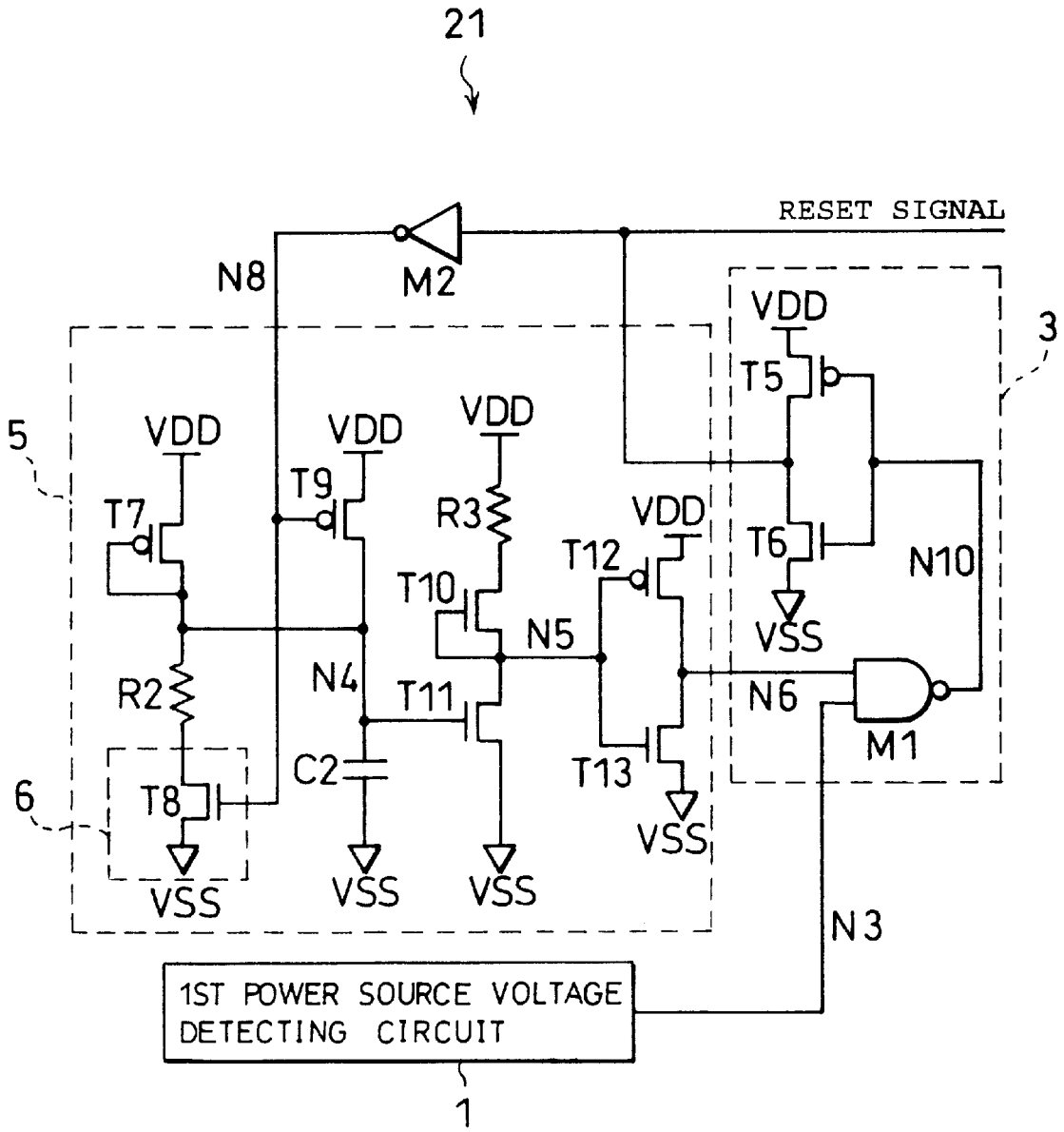
FIG. 4 is a circuit diagram depicting an arrangement of an integrated circuit in accordance with another embodiment of the present invention.
Figure 5:
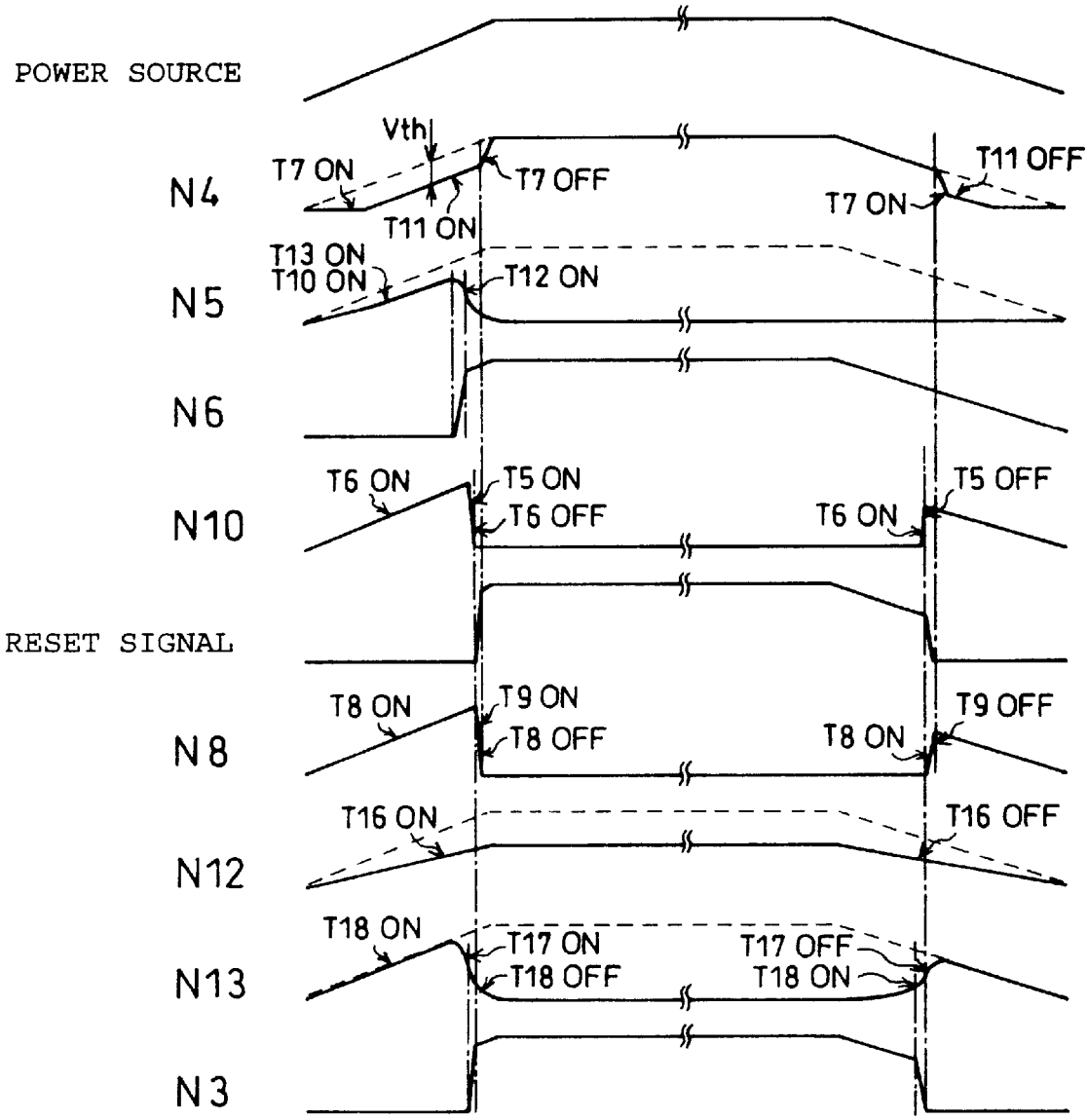
FIG. 5 is a timing chart explaining the operation of the integrated circuit of FIG. 4 in case of a slow rising power source voltage.
Figure 6:
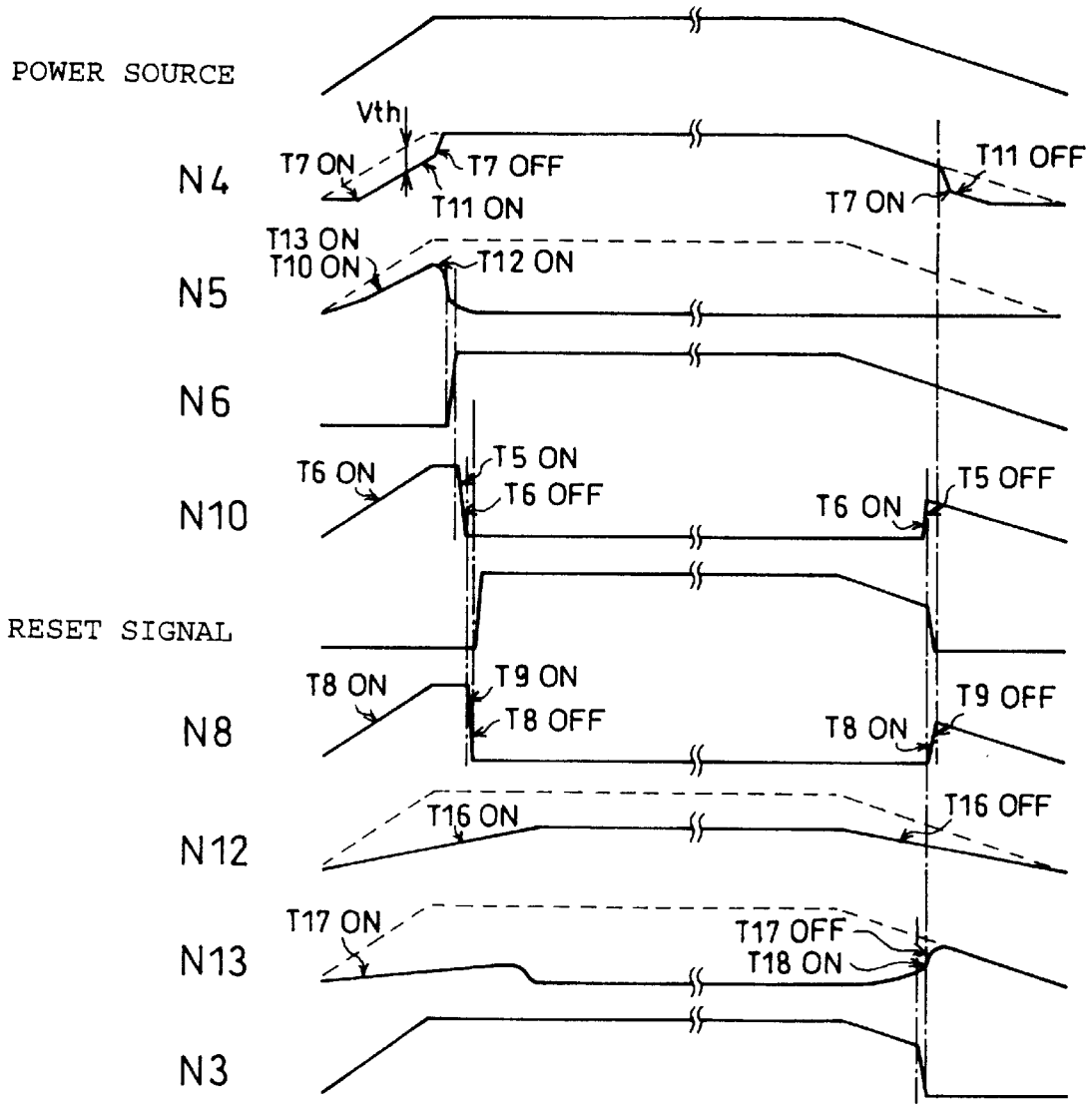
FIG. 6 is a timing chart explaining the operation of the integrated circuit of FIG. 4 in case of a fast rising power source voltage.

Referring to FIGS. 4 through 6, the following description will describe an example of an integrated circuit in accordance with another embodiment of the present invention. Hereinafter, like components are labeled with like reference numerals with respect to Embodiment 1, and the description of these components is not repeated for ease of explanation.

As shown in FIG. 4, an integrated circuit 21 of the present embodiment includes a first power source voltage detecting circuit 1, a reset signal generating circuit 3, a second power source voltage detecting circuit 5, and an inverter M2.

In the second power source voltage detecting circuit 5, a serial circuit composed of a PMOS transistor (third switching element) T7, a resistor R2, and an NMOS transistor (fourth switching element;switch;cutting circuit) T8 is formed between a power source line VDD and an earth line VSS. The source of the PMOS transistor T7 is connected to the power source line VDD, and the drain thereof is connected to its own gate (control terminal) and to one end of the resistor 2. The gate of the NMOS transistor T8 is connected to an output terminal of the inverter M2 which will be described below, and the drain thereof is connected to the other end of the resistor R2, and the source is connected to the earth line VSS.

A connection point of the PMOS transistor T7 and resistor R2, that is, a node N4 (first node), is connected to the power source line VDD through a PMOS transistor (fifth switching element) T9, and to the earth line VSS through a capacitor C2. The gate of the PMOS transistor T9 is connected to the output terminal of the inverter M2, the source thereof is connected to the power source line VDD, and the drain thereof is connected to the node N4. One end of the capacitor C2 is connected to the node N4, and the other end thereof is connected to the earth line VSS.

Also, a serial circuit composed of a resistor (serial resistor) R3, an NMOS transistor (first switching element) T10, and an NMOS transistor (second switching element) T11 is formed between the power source line VDD and earth line VSS. One end of the resistor R3 is connected to the power source line VDD, and the other end thereof is connected to the drain of the NMOS transistor T10. The source of the NMOS transistor T10 is connected to its own gate and to the drain of the NMOS transistor T11. The gate of the NMOS transistor T11 is connected to the node N4, and the source thereof is connected to the earth line VSS.

Further, a CMOS inverter detecting section composed of a serial circuit having a PMOS transistor T12 and an NMOS transistor T13 is formed between the power source line VDD and earth line VSS. The source of the PMOS transistor T12 is connected to the power source line VDD, and the drain thereof is connected to the drain of the NMOS transistor T13. The source of the NMOS transistor T13 is connected to the earth line VSS. Each of the gates of the PMOS transistor T12 and NMOS transistor T13 is connected to a connection point (node N5;second node) of the NMOS transistors T10 and T11. A connection point (node NG) of the PMOS transistor T12 and NMOS transistor T13 is connected to an input terminal of a NAND circuit M1 of the reset signal generating circuit 3 as an output terminal of the second power source voltage detecting circuit 5.

Here, the resistors R2 and R3 are given with small resistance values of approximately 150 kΩ, and the capacity of the capacitor C2 is approximately 3 pF. Because small resistance values are given to the resistors R2 and R3, the second power source voltage detecting circuit 2 consumes a current significantly, but it can detect transition of the power source voltage in case of the fast rising power source voltage. Also, the NMOS transistor T8 forms a DC path cutting circuit (current cutting circuit) 6 which cuts a DC path during standby, so that a current will not flow from the power source line VDD to the earth line VSS through the PMOS transistor T7, resistor R2, and NMOS transistor T8.

The input terminal of the inverter M2 is connected to a connection point of the PMOS transistor T5 and NMOS transistor T6 forming the CMOS inverter in the reset signal generating circuit 3, that is, the reset terminal. As previously mentioned, the output terminal (node N8) of the inverter M2 is connected to the gate of the NMOS transistor T8.

The following will explain the operation of the above-arranged integrated circuit 21 in cases of the slow rising and fast rising power source voltages with reference to timing charts of FIGS. 5 and 6, respectively.

A case of the slow rising power source voltage will be explained first with reference to FIG. 5. As shown in the drawing, in the second power source voltage detecting circuit 5, when the power source voltage is supplied to the power source line VDD, the voltage at the node N4 shifts to the low level through the capacitor C2, whereupon the NMOS transistor T11 is switched OFF. Then, the voltage at the node N5 increases as the power source voltage rises by a parasitic capacity of the NMOS transistor T10 which stays OFF and shifts to the high level. When the voltage at the node N5 reaches the threshold of the transistor T10, the NMOS transistor T10 is switched ON and the gate and source of the NMOS transistor T1O are connected to each other, whereby the voltage at the node N5 increases further while remaining below the power source voltage.

When the voltage at the node N5 reaches the threshold of the NMOS transistor T13, the PMOS transistor T12 is switched OFF whereas the NMOS transistor T13 is switched ON, whereby the voltage at the node N6 shifts to the low level. Thus, an output of the NAND circuit M1 which receives the voltage at the node N6 as an input, that is, the voltage at the node N10, shifts to the high level regardless of the output of the first power source voltage detecting circuit 1, that is, the voltage at the node N3.

When the voltage at the node N10 shifts to the high level, in the CMOS inverter of the reset signal generating circuit 3, the PMOS transistor T5 is switched OFF whereas the NMOS transistor T6 is switched ON, whereby the reset signal shifts to the low level from the initial floating state immediately after the power source supply. Accordingly, an output of the inverter M2, that is, the voltage at the node N8, shifts to the high level, whereupon the NMOS transistor T8 is switched ON. Consequently, the node N4 is connected to the earth line VSS through the resistor R2 and NMOS transistor T8.

When the power source voltage reaches the threshold Vth of the PMOS transistor T7, the PMOS transistor T7 is switched ON, whereby the node N4 is connected to the power source line VDD through the PMOS transistor T7. Thus, because the gate and drain of the PMOS transistor T7 are connected to each other, the voltage at the node N4 further increases while staying lower than the power source voltage by the threshold Vth, and shifts to the high level. When the voltage at the node N4 shifts to the high level, the NMOS transistor T11 is switched ON, whereupon the node N5 is connected to the earth line VSS through the NMOS transistor T11. Consequently, the voltage at the node N5 shifts to the low level from the high level.

Thus, when the power source voltage reaches a predetermined value (high level) the voltage at the node N4 which functions as a switching control terminal of the NMOS transistor T11 shifts to the high level from the low level, whereupon the NMOS transistor T11 is switched ON from OFF. Consequently, the voltage at the node N5 shifts to the low level from the high level. Also, because the NMOS transistor T10 is switched OFF, a current is not allowed to flow through a path from the power source line VDD to the earth line VSS through the resistor R3, and NMOS transistors T1O and T11.

As has been discussed, by giving a small resistance value to the resistor R2, in detecting the rising of the power source voltage, the voltage level of the node N5 changes without delay when the power source voltage exceeds the predetermined voltage, When the voltage at the node N5 shifts to the low level, the PMOS transistor T12 is switched ON, whereupon the voltage at the node NG shifts to the high level. On the other hand, in the first power source voltage detecting circuit 1, the voltages at the nodes N12, N13, and N3 change in the same manner as was described in the prior art column. Thus, when the voltage at the node N3 shifts to the high level from the low level, the output of the NAND circuit M1, that is, the voltage at the node N10, shifts to the low level.

Thus, in the, CMOS inverter of the reset signal generating circuit 3, the PMOS transistor T5 is switched ON whereas the NMOS transistor T6 is switched OFF, whereupon the reset signal shifts to the high level. Because the output of the inverter M2, that is, the voltage at the node N8, shifts to the low level, the NMOS transistor T8 is switched OFF whereas the PMOS transistor T9 is switched ON. Because the NMOS transistor T8 which functions as the DC path cutting circuit 6 is switched OFF, the DC path from the power source line VDD to the earth line VSS through the PMOS transistor T7, resistor R2, and NMOS transistor T8 is cut. Consequently, even when the resistor R2 is given with a small resistance value, the current consumption of the second power source voltage circuit 5 can be saved.

Then, the reset signal stays in the high level while the power source voltage maintains a normal value. When the power source voltage starts to drop, the voltages at the nodes N4 and N6 and the reset signal start to drop as well, because the PMOS transistors T9, T12, and T5 stay ON. When the voltage at the node N3 drops to the low level, the voltage at the node N10 shifts to the high level, whereupon, in the CMOS inverter of the reset signal generating circuit 3, the PMOS transistor T5 is switched OFF whereas the NMOS transistor T6 is switched ON. Consequently, the reset signal shifts to the low level.

Next, a case of the fast rising power source voltage will be explained with reference to FIG. 6. As shown in the drawing, in the second power source voltage detecting circuit 5, when a power source voltage is supplied to the power source line VDD, the voltage at the node N4 shifts to the low level through the capacitor C2, whereby the NMOS transistor T11 is switched OFF, and the voltage at the node N5 increases as the power source voltage rises by a parasitic capacity of the NMOS transistor T10 which stays OFF and shifts to the high level. When the voltage at the node N5 reaches the threshold of the NMOS transistor T10, the NMOS transistor T10 is switched ON, whereby the gate and source of the NMOS transistor T10 are connected to each other. Then, the voltage at the node N5 increases further while staying below the power source voltage.

When the voltage at the node N5 reaches the threshold of the NMOS transistor T13, the NMOS transistor T13 is switched ON, whereupon the voltage at the node N6 shifts to the low level. Thus, an output of the NAND circuit M1 which receives the voltage at the node N6 as an input, that is, the voltage at the node N10, shifts to the high level regardless of an output of the first power source voltage detecting circuit 1, that is, the voltage at the node N3.

Because the voltage at the node N10 shifts to the high level, in the CMOS inverter of the reset signal generating circuit 3, the PMOS transistor T5 is switched OFF whereas the NMOS transistor T6 is switched ON. Consequently, the reset signal shifts to the low level from the initial floating state immediately after the power source supply. Accordingly, an output of the inverter M2, that is, the voltage at the node N8, shifts to the high level, whereupon the NMOS transistor T8 is switched ON. Consequently, the node N4 is connected to the earth line VSS through the resistor R2 and NMOS transistor T8.

When the power source voltage reaches the threshold Vth of the PMOS transistor T7, the PMOS transistor T7 is switched ON, whereby the node N4 is connected to the power source line VDD through the PMOS transistor T7. Thus, because the gate and drain of the PMOS transistor T7 are connected to each other, the voltage at the node N4 increases while staying lower than the power source voltage by the threshold Vth and shifts to the high level. When the voltage at the node N4 shifts to the high level, the NMOS transistor T11 is switched ON, whereby the node N5 is connected to the earth line VSS through the NMOS transistor T11. Consequently, the voltage at the node N5 shifts to the low level from the high level.

Thus, when the power source voltage reaches a predetermined value (high level), the voltage at the node N5 shifts to the low level from the high level without delay, because the resistor R2 is given with a small resistance value. Accordingly, because the NMOS transistor T10 is switched OFF, a current is not allowed to flow through the path from the power source line VDD to the earth line VSS through the resistor R3, and NMOS transistors T1O and T11.

When the voltage at the node N5 shifts to the low level, the PMOS transistor T12 is switched ON, whereupon the voltage at the node NG shifts to the high level. On the other hand, in the first power source voltage detecting circuit 1, the voltages at the nodes N12, N13, and N3 change in the same manner as was described in the prior art column and the voltage at the node N3 has shifted to the high level. Hence, when the voltage at the node NG shifts to the high level, an output of the NAND circuit MI, that is, the voltage at the node N10, shifts to the low level.

Thus, in the CMOS inverter of the reset signal generating circuit 3, the PMOS transistor T5 is switched ON whereas the NMOS transistor T6 is switched OFF, whereby the reset signal shifts to the high level. In this manner, by using the output of the first power source voltage detecting circuit 1 and the output from the second power source voltage detecting circuit 5, the rising of the reset signal can be controlled even in case of the fast rising power source voltage.

At this point, an output of the inverter M2, that is, the voltage at the node N8, shifts to the low level, whereupon the NMOS transistor T8 is switched OFF whereas the PMOS transistor T9 is switched ON. Because the NMOS transistor T8 functioning as the DC path cutting circuit 6 is switched OFF, the DC path from the power source line VDD to the earth line VSS through the PMOS transistor T7, resistor R2, and NMOS transistor T8 is cut. Consequently, the standby current consumption of the second power source voltage detecting circuit 5 can be saved.

Then, the reset signal stays in the high level while the power source voltage maintains a normal value, and when the power source voltage starts to drop, the voltages at the nodes N6 and N4 and the reset signal start to drop as well, because the PMOS transistors T9, T12, and T5 stay ON. Then, when the voltage at the node N3 drops to the low level, the voltage at the node N1O shifts to the high level, and in the CMOS inverter of the reset signal generating circuit 3, the PMOS transistor T5 is switched OFF whereas the NMOS transistor T6 is switched ON, whereby the reset signal shifts to the low level.

In the above-arranged second power source voltage detecting circuit 5, the power source voltage at the falling and the output of the second power source voltage detecting circuit 5 (voltage at the node N6) have the same potential. Thus, the voltage at the node N6 stays in the high level, and therefore, the integrated circuit 21 can not recognize the low level in the voltage at the node N6. Hence, in order to control the falling of the reset signal by detecting the falling of the power source voltage, the integrated circuit 21 of the present embodiment uses the falling of the voltage at the node N3 in the first power source voltage detecting circuit 1.

As has been discussed, the integrated circuit 21 of the present embodiment can generate and output an adequate reset signal in response to the rising and falling of the power source voltage in case of either the slow or fast rising power source voltage. Also, because an arrangement such that cuts the DC path is provided at the same time, the standby current consumption can be saved.

In Embodiments 1 and 2, the cutting circuit (4;6) cuts the DC path while the reset signal maintains a normal value (stays in the high level). However, the arrangement is not limited to the foregoing. If the cutting period is arranged to start when the first power source voltage detecting circuit (1) detects that the power source voltage VDD exceeds the predetermined value and end when it detects that the power source voltage VDD drops below the predetermined value, then power consumption throughout the above cutting period can be saved. It should be noted, however, that the longer the cutting period, the more the power consumption is saved, and therefore, it is preferable to cut the DC path throughout the period while the reset signal maintains the normal value as was described in Embodiments 1 and 2.

If it can be arranged so as to cut the DC path during the above cutting period, the cutting period can be detected based on the output of the first power source voltage detecting circuit 1 or the output of the NAND circuit M1, for example.

As has been discussed, an integrated circuit of the present invention is an integrated circuit for generating a pulse of a reset signal to stay at a high potential level for a predetermined period after a power source voltage is supplied, comprising:

a first power source voltage detecting circuit for detecting a falling of the power source voltage;

a second power source voltage detecting circuit for detecting a rising of the power source voltage; and a reset signal generating circuit for generating the reset signal whose rising timing and falling timing are controlled in accordance with detection results from said first and second power source voltage detecting circuits, said second power source voltage detecting circuit being furnished with a current cutting circuit which cuts a current flowing therein while said reset signal generating circuit is generating the reset signal.

According to the above arrangement, two detecting circuits, the first power source voltage detecting circuit for detecting the falling of the power source voltage and the second power source voltage detecting circuit for detecting the rising of the power source voltage, are provided, and the rising and falling of the reset signal are controlled in accordance with the detection results from these circuits. Further, the problem of increasing current consumption caused by the conventional rising detecting circuit, that is, the second power source voltage detecting circuit has to be arranged to operate on a fast rising power source voltage, for example, by giving a small resistance value to the resistor provided on the path of the current flowing therein, can be solved by providing a current cutting circuit which cuts the current while the reset signal is generated.

Consequently, an integrated circuit which can save the standby current consumption and at the same time output the reset signal properly in response to the power source voltage at any rising rate can be provided.

In addition to the above arrangement, it is preferable that said second power source voltage detecting circuit is furnished with a rising detecting terminal for detecting a rising of the power source voltage by detecting shift of a voltage level of said rising detecting terminal when the power source voltage exceeds a predetermined value during a rising period.

According to the above arrangement, the second power source voltage detecting circuit detects the rising of the power source voltage during the rising period after the power source voltage is supplied by detecting that the voltage level of the rising detecting terminal shifts from the high level to the low level or from the low level to the high level when the power source voltage exceeds the predetermined value. Thus, by using the output from the second power source voltage detecting circuit based on the above detection result and the output of the first power source voltage detecting circuit, the reset signal generating circuit can generate an adequate reset signal in response to the power source voltage at any rising rate.

Further, the integrated circuit may be additionally arranged in such a manner that:

said rising detecting terminal is a connection point of one end of a capacitor which is connected to an applying line at a high voltage end of the power source voltage at the other end, and one end of a first switching element which is connected to an applying line at a low voltage end of the power source voltage at the other end and stays in a cutting state until the power source voltage reaches a switching ON level and shifts to a conducting state when the power source voltage reaches the switching ON level; and said rising detecting terminal is connected to one end of a second switching element through a resistor, said second switching element being connected to the applying line at the high voltage end of the power source voltage at the other end, said second switching element switching to the conducting state from the cutting state while the reset signal is not generated, and to the cutting state from the conducting state as said current cutting circuit while the reset signal is generated.

According to the above arrangement, the first switching element is in the cutting state until the power source voltage reaches the switching ON level, and for example, if the second switching element is in the cutting state at this point, then, the voltage at the rising detecting terminal increases as high as the power source voltage through the capacitor, and the rising detecting terminal can be set to the high level immediately before the power source voltage reaches the switching ON level.

When the power source voltage reaches the switching ON level, the first switching element shifts to the conducting state, and for example, if the second switching element also shifts to the conducting state, then, the rising detecting terminal is connected to the applying line at the low voltage end of the power source voltage, and to the applying line at the high voltage end of the power source voltage through the resistor. Then, the voltage at the rising detecting terminal starts to drop gradually, and this state can be defined as the low level. While the reset signal is generated based on the fact that the voltage at the rising detecting terminal shifts to the low level, the first switching element is in the conducting state. Hence, the rising detecting terminal maintains the low level.

While the reset signal is generated, the second switching element serving as the current cutting circuit is in the cutting state. Thus, no current is allowed to flow from the applying line at the high voltage end of the power source voltage to the applying line at the low voltage end of the power source voltage.

Thus, by setting a small resistance value, it has become possible to realize the rising detecting terminal whose voltage level varies without delay when the power source voltage exceeds the predetermined value in case of either the fast or slow rising power source voltage. Thus, the rising of the reset signal can be controlled based on the detection result from the rising detecting terminal. Also, because no current is allowed to flow from the applying line at the high voltage end of the power source voltage to the applying line at the low voltage end of the power source voltage while the reset signal is generated, the standby current consumption can be saved even if a small resistance value is given to the resistor.

As another preferable embodiment, in addition to the arrangement of the rising detecting terminal, the integrated circuit may be arranged in such a manner that:

said rising detecting terminal is a connection point of one end of a first switching element which is connected to an applying line of a high voltage end of the power source voltage at the other end through a resistor, and stays in a cutting state until the power source voltage reaches a switching ON level and shifts to a conducting state when the power source voltage reaches the switching ON level, and one end of a second switching element which is connected to an applying line at a low voltage end of the power source voltage at the other end, and stays in the cutting state until a voltage at a switching control terminal reaches the switching ON level and shifts to the conducting state when the voltage at the switching control terminal reaches the switching ON level;

the switching ON level of said first switching element is determined by a voltage at said rising detecting terminal;

said first switching element includes a parasitic capacity between two ends thereof;

said switching control terminal is a connection point of one end of a capacitor which is connected to the applying line at the low voltage end of the power source voltage at the other end, and one end of a third switching element which is connected to the applying line at the high voltage end of the power source voltage at the other end, and stays in the cutting state until the power source voltage reaches the switching ON level and shifts to the conducting state when the power source voltage reaches the switching ON level;

said switching control terminal is connected to one end of a fourth switching element through a register, said fourth switching element being connected to the applying line at the low voltage end of the power source voltage at the other end, said fourth switching element switching to the conducting state from the cutting state. While the reset signal is not generated, and to the cutting state from the conducting state as said current cutting circuit while the reset signal is generated; and said switching control terminal is connected to one end of a fifth switching element which is connected to the applying line at the high voltage end of the power source voltage at the other end, and switches to the cutting state from the conducting state while the reset signal is not generated and switches to the conducting state from the cutting state while the reset signal is generated.

According to the above arrangement, the voltage at the switching control terminal drops as low as that of the applying line at the low voltage end of the power source voltage through the capacitor when the power source is supplied. Because the first through fifth switching elements are in the cutting state at this point, the voltage at the rising detecting terminal increases as the power source voltage on the applying line at the high voltage end rises by the parasitic capacity of the first switching element. Then, when the power source voltage reaches the switching ON level of the third switching element, the third switching element shifts to the conducting state, and for example, if the fourth switching element is in the conducting state, then, the voltage at the switching control terminal increases gradually as the power source voltage rises. The voltage at the rising detecting terminal keeps increasing until the voltage at the switching control terminal reaches the switching ON level of the second switching element, the rising detecting terminal can be maintained in the high level immediately before the second switching element shifts to the conducting state.

Once the voltage at the switching control terminal reaches the switching ON level of the second switching element and the second switching element shifts to the conducting state, the rising detecting terminal is connected to the applying line at the lower voltage end of the power source voltage through the second switching element. Thus, the voltage at the rising detecting terminal starts to drop gradually. When the power source voltage exceeds the predetermined value and increases further, the voltage at the rising detecting terminal drops further, and this state of the rising detecting terminal can be defined as the low level. Then, by generating the reset signal based on the fact that the voltage at the rising detecting terminal has shifted to the low level, the fifth switching element shifts to the conducting state. Then, the switching control terminal is connected to the applying line at the high voltage end of the switching control terminal and maintained at the high level. In other words, the rising detecting terminal maintains the low level.

Further, when the voltage at the rising detecting terminal shifts to the low level, the first switching element shifts to the cutting state, and the fourth switching element serving as the current cutting circuit shifts to the cutting state while the reset signal is generated. Thus, no current is allowed to flow from the applying line at the high voltage end of the power source voltage to the applying line at the low voltage end of the power source voltage.

Hence, by giving a small resistance value to the resistor, it has become possible to realize the rising detecting terminal whose voltage level varies without delay when the power source voltage exceeds the predetermined value in case of either the fast or slow rising power source voltage. Thus, the rising of the reset signal can be controlled based on the detection result from the rising detecting terminal. Also, because no current is allowed to flow from the applying line at the high voltage end of the power source voltage to the applying line at the low voltage end of the power source voltage while the reset signal is generated, the standby current consumption can be saved even if a small resistance value is given to the resistor.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An integrated circuit for generating a reset signal in a normal period during which a power source voltage maintains a predetermined threshold, comprising:

first and second power source voltage detecting circuits for detecting whether the power source voltage reaches said threshold or not, each having a different operation rate and different power consumption; and a reset signal generating circuit for generating the reset signal based on detection results from said first and second power source voltage detecting circuits, said second power source voltage detecting circuit having a higher operation rate being furnished with a cutting circuit for cutting a current flowing therein when said first power source voltage detecting circuit having smaller power consumption detects that the power source voltage reaches said threshold.

2. The integrated circuit of claim 1, wherein:

said second power source voltage detecting circuit maintains an output at a level at the instant the current is cut while the current is kept cut; and the reset signal generating circuit includes a logical circuit which maintains the reset signal at a first level indicating said normal period when both of said first and second power source voltage detecting circuits detect that the power source voltage reaches said threshold.

3. The integrated circuit of claim 1, wherein said cutting circuit cuts the current when the reset signal indicates said normal period.

4. The integrated circuit of claim 1, wherein:

each of said first and second power source voltage detecting circuits is furnished with a resistor and a detecting circuit, said resistor being provided on a DC path starting from a first power source line to which the power source voltage is supplied and ending at a second power source line kept at a predetermined potential lower than the power source voltage said detecting circuit detecting whether the power source voltage reaches said threshold based on a potential at one end of said resistor serving as a first node;

a resistance value of said resistor provided to said second power source voltage detecting circuit is set smaller than a resistance value of said resistor provided to said first power source voltage detecting circuit; and said cutting circuit is a switch provided on the DC path in said second power source voltage detecting circuit.

5. The integrated circuit of claim 4, wherein the detecting circuit of said second power source voltage detecting circuit detects that the power source voltage reaches said threshold when a potential at said first node shifts to a low level from a high level, and wherein said second power source voltage detecting circuit is further furnished with:

a first switching element which is provided between a lower potential end of said resistor serving as said first node and said second power source line and conducts when the power source voltage is applied to a control terminal and reaches a predetermined switching ON level;

a capacitor provided between the low potential end of said resistor and said first power source line; and a second switching element provided between a high potential end of said resistor and said first power source line.

6. The integrated circuit of claim 5, wherein the reset signal generating circuit includes a logical circuit for maintaining the reset signal at a first level indicating said normal period when both of said first and second power source voltage detecting circuit detect that the power source voltage reaches said threshold.

7. The integrated circuit of claim 4, wherein:

the detecting circuit of said second power source voltage detecting circuit is furnished with a detecting unit which detects that the power source voltage reaches said threshold when a potential at a second node shifts to a low level from a high level;

a serial resistor connected to said first power source line at one end;

a first switching element which is provided between the other end of said serial resistor and said second node and conducts when a potential at said second node reaches a predetermined switching ON level; and a second switching element which is provided between said second node and said second power source line and conducts when a potential at said first node reaches a predetermined switching ON level, and wherein said second power source voltage detecting circuit is further furnished with:

a third switching element which is provided between a high potential end of said resistor serving as said first node and said first power source line, connected to said first node at a control terminal, and conducts when the power source voltage reaches a predetermined switching ON level;

a fourth switching element which is provided between a low potential end of said resistor and said second power source line as said switch and conducts while the reset signal is generated;

a fifth switching element which is provided between said first node and said first power source line and kept cut while the reset signal is generated; and a capacitor provided between said first node and said second power source line.

8. The integrated circuit of claim 7, wherein the reset signal generating circuit includes a logical circuit for maintaining the reset signal at a first level indicating said normal period when both of said first and second power source voltage detecting circuits detect that the power source voltage reaches said threshold.

9. An integrated circuit for generating a pulse of a reset signal to stay at a high potential level for a predetermined period after a power source voltage is supplied, comprising:

a first power source voltage detecting circuit for detecting a falling of the power source voltage;

a second power source voltage detecting circuit for detecting a rising of the power source voltage; and a reset signal generating circuit for generating the reset signal whose rising timing and falling timing are controlled in accordance with detection results from said first and second power source voltage detecting circuits, said second power source voltage detecting circuit being furnished with a current cutting circuit which cuts a current flowing therein while said reset signal generating circuit is generating the reset signal.

10. The integrated circuit of claim 9, wherein said second power source voltage detecting circuit is furnished with a rising detecting terminal for detecting a rising of the power source voltage by detecting shift of a voltage level of said rising detecting terminal when the power source voltage exceeds a predetermined value during a rising period.

11. The integrated circuit of claim 10, wherein:

said rising detecting terminal is a connection point of one end of a capacitor which is connected to an applying line at a high voltage end of the power source voltage at the other end, and one end of a first switching element which is connected to an applying line at a low voltage end of the power source voltage at the other end and stays in a cutting state until the power source voltage reaches a switching ON level and shifts to a conducting state when the power source voltage reaches the switching ON level; and said rising detecting terminal is connected to one end of a second switching element through a resistor, said second switching element being connected to the applying line at the high voltage end of the power source voltage at the other end, said second switching element switching to the conducting state from the cutting state while the reset signal is not generated, and to the cutting state from the conducting state as said current cutting circuit while the reset signal is generated.

12. The integrated circuit of claim 10, wherein:

said rising detecting terminal is a connection point of one end of a first switching element which is connected to an applying line of a high voltage end of the power source voltage at the other end through a resistor, and stays in a cutting state until the power source voltage reaches a switching ON level and shifts to a conducting state when the power source voltage reaches the switching ON level, and one end of a second switching element which is connected to an applying line at a low voltage end of the power source voltage at the other end, and stays in the cutting state until a voltage at a switching control terminal reaches the switching ON level and shifts to the conducting state when the voltage at the switching control terminal reaches the switching ON level;

the switching ON level of said first switching element is determined by a voltage at said rising detecting terminal;

said first switching element includes a parasitic capacity between two ends thereof;

said switching control terminal is a connection point of one end of a capacitor which is connected to the applying line at the low voltage end of the power source voltage at the other end, and one end of a third switching element which is connected to the applying line at the high voltage end of the power source voltage at the other end, and stays in the cutting state until the power source voltage reaches the switching ON level and shifts to the conducting state when the power source voltage reaches the switching ON level;

said switching control terminal is connected to one end of a fourth switching element through a register, said fourth switching element being connected to the applying line at the low voltage end of the power source voltage at the other end, said fourth switching element switching to the conducting state from the cutting state while the reset signal is not generated, and to the cutting state from the conducting state as said current cutting circuit while the reset signal is generated; and said switching control terminal is connected to one end of a fifth switching element which is connected to the applying line at the high voltage end of the power source voltage at the other end, and switches to the cutting state from the conducting state while the reset signal is not generated and switches to the conducting state from the cutting state while the reset signal is generated.

* * * * *

UNITED STATES PATENT AND TRADEMARK OFFICE

CERTIFICATE OF CORRECTION

PATENT NO. : 6,351,109 B1
DATED : February 26, 2002
INVENTOR(S) : Megumi Yoshida It is certified that error appears in the above-identified patent and that said Letters Patent is hereby corrected as shown below:

Title page,
Item [30], FOREIGN PATENT DOCUMENTS, please delete
"JP 04039956 2/1992
JP 04103637 3/1992
JP 04152891 5/1992".

Signed and Sealed this

Seventeenth Day of December, 2002

JAMES E. ROGAN
*Director of the United States Patent and Trademark Office*